US007654402B2

(12) United States Patent
Kusuma et al.

(10) Patent No.: US 7,654,402 B2
(45) Date of Patent: Feb. 2, 2010

(54) COLLAPSIBLE CONTAINER

(75) Inventors: David Kusuma, Orlando, FL (US); Peter M. Card, Plant City, FL (US); Hector Javier Barea Lugo, Orlando, FL (US)

(73) Assignee: Dart Industries Inc., Orlando, FL (US)

( * ) Notice: Subject to any disclaimer, the term of this patent is extended or adjusted under 35 U.S.C. 154(b) by 189 days.

(21) Appl. No.: 10/735,724

(22) Filed: Dec. 16, 2003

(65) Prior Publication Data

US 2005/0127073 A1 Jun. 16, 2005

(51) Int. Cl.
*B65D 6/16* (2006.01)

(52) U.S. Cl. ..... 220/8; 220/666

(58) Field of Classification Search ..... 220/6, 220/574, 675, 672; 215/900
See application file for complete search history.

(56) References Cited

U.S. PATENT DOCUMENTS

| | | | |
|---|---|---|---|
| 1,048,935 | A | 12/1912 | Brady |
| 2,725,087 | A | 11/1955 | Potter |
| 2,780,378 | A | 2/1957 | Romano |
| 2,880,902 | A | 4/1959 | Owsen |
| 2,899,110 | A | 8/1959 | Parker |
| 3,083,877 | A | 4/1963 | Gash |
| 3,220,544 | A | 11/1965 | Lovell |
| 3,220,554 | A | 11/1965 | Lovell |
| 3,301,293 | A | 1/1967 | Santelli |
| 3,319,684 | A | 5/1967 | Calhoun |
| 3,586,084 | A | 6/1971 | Redmond |
| 3,939,887 | A | 2/1976 | Scarnato |
| 3,939,888 | A | 2/1976 | Scarnato |
| 4,157,103 | A | 6/1979 | La Fleur |
| 4,377,191 | A | 3/1983 | Yamaguchi |
| 4,456,134 | A | 6/1984 | Cooper |
| 4,492,313 | A | 1/1985 | TouzanI |
| RE32,379 | E | 3/1987 | Touzani |
| 4,773,458 | A | 9/1988 | Touzani |
| 4,775,564 | A | 10/1988 | Shriver |
| 4,790,361 | A | 12/1988 | Jones et al. |
| 4,873,100 | A | 10/1989 | Dirksing et al. |
| 4,875,576 | A | 10/1989 | Torgrimson |

(Continued)

FOREIGN PATENT DOCUMENTS

| | | | |
|---|---|---|---|
| CN | 2078983 | U | 6/1991 |

(Continued)

OTHER PUBLICATIONS

Normann Copenhagen, Denmark, Design: Boje Estermann, 2004 Funnel: front and back of package and two photographs of funnel collapsed and extend.

(Continued)

*Primary Examiner*—Stephen Castellano

(57) ABSTRACT

A collapsible container with angularly related multiple folding sections, each section extending at an angle to the vertical and including, within each section itself, a flexure zone adjacent the angular joint between adjacent sections and flexibly movable between a first open position in the expanded container and a second position folded upon itself in the collapsed container, the flexure zones resisting movement of the sections in both the fully expanded container and the collapsed container, as well as any intermediate position wherein only selected flexure zones are in an open position.

25 Claims, 7 Drawing Sheets

U.S. PATENT DOCUMENTS

| | | | |
|---|---|---|---|
| 4,898,306 | A | 2/1990 | Pardes |
| 4,927,191 | A | 5/1990 | Mikol |
| 4,930,644 | A | 6/1990 | Robbins, III |
| 4,955,493 | A | 9/1990 | Touzani |
| 5,002,193 | A | 3/1991 | Touzani |
| 5,114,011 | A | 5/1992 | Robbins, III |
| 5,137,183 | A | 8/1992 | Mikulec et al. |
| 5,201,438 | A | 4/1993 | Norwood |
| 5,209,372 | A | 5/1993 | Norwood |
| 5,224,613 | A | 7/1993 | Robbins, III |
| 5,226,551 | A | 7/1993 | Robbins, III |
| 5,240,130 | A | 8/1993 | Osbakk |
| 5,269,428 | A | 12/1993 | Gilbert |
| D344,210 | S | 2/1994 | Cousins et al. |
| 5,292,242 | A | 3/1994 | Robbins, III |
| 5,310,068 | A | 5/1994 | Saghri |
| D349,005 | S | 7/1994 | Cousins et al. |
| 5,333,761 | A | 8/1994 | Davis et al. |
| 5,348,173 | A | 9/1994 | Norwood |
| 5,370,250 | A | 12/1994 | Gilbert |
| 5,384,138 | A | 1/1995 | Robbins, III et al. |
| 5,392,941 | A | 2/1995 | Robbins, III |
| 5,417,337 | A | 5/1995 | Robbins, III |
| 5,429,261 | A | 7/1995 | Machino |
| 5,439,128 | A | 8/1995 | Fishman |
| 5,524,789 | A | 6/1996 | Jackman |
| 5,533,638 | A | 7/1996 | Robbins, III |
| 5,536,194 | A | 7/1996 | Larsen et al. |
| 5,549,213 | A | 8/1996 | Robbins, III et al. |
| 5,562,228 | A | 10/1996 | Ericson |
| 5,573,129 | A | 11/1996 | Nagata et al. |
| 5,575,398 | A | 11/1996 | Robbins, III |
| 5,584,413 | A | 12/1996 | Jung |
| 5,631,053 | A | 5/1997 | Andersen et al. |
| 5,632,406 | A | 5/1997 | Robbins, III |
| 5,731,021 | A | 3/1998 | Spector |
| 5,758,789 | A | 6/1998 | Shin et al. |
| 5,758,802 | A | 6/1998 | Wallays |
| 5,860,556 | A | 1/1999 | Robbins, III |
| 5,900,293 | A | 5/1999 | Zettle |
| 5,911,338 | A | 6/1999 | Miller |
| 5,913,448 | A | 6/1999 | Mann et al. |
| RE36,377 | E | 11/1999 | Gilbert |
| 5,996,882 | A | 12/1999 | Randall |
| 6,015,056 | A | 1/2000 | Overholt et al. |
| 6,047,848 | A | 4/2000 | Davis |
| 6,092,687 | A | 7/2000 | Hupp et al. |
| 6,164,821 | A | 12/2000 | Randall |
| 6,220,473 | B1 | 4/2001 | Lehman et al. |
| 6,315,151 | B1 | 11/2001 | Hupp et al. |
| 6,394,299 | B1 | 5/2002 | Hupp |
| 6,811,051 | B2 | 11/2004 | Higuchi |
| D522,809 | S * | 6/2006 | Kusuma et al. ..... D7/602 |
| 2001/0006164 | A1 | 7/2001 | de Begon de Larouziere |
| 2003/0230588 | A1 | 12/2003 | Zepter |
| 2008/0099476 | A1 * | 5/2008 | Fung ..... 220/6 |
| 2009/0114657 | A1 * | 5/2009 | Hsu ..... 220/574 |

FOREIGN PATENT DOCUMENTS

| | | | |
|---|---|---|---|
| CN | 2249525 | Y | 3/1997 |
| CN | 2285602 | Y | 7/1998 |
| CN | 2301895 | Y | 12/1998 |
| CN | 2321280 | Y | 6/1999 |
| CN | 3123659D | | 10/1999 |
| CN | 3133258D | | 1/2000 |
| CN | 2412846 | Y | 1/2001 |
| CN | 2429451 | | 5/2001 |
| CN | 3193194D | | 7/2001 |
| CN | 2471193 | Y | 1/2002 |
| CN | 3302690D | | 6/2003 |
| FR | 1124843 | | 10/1956 |
| FR | 994377 | | 10/1999 |
| JP | 1984-118732 | | 8/1984 |
| JP | 1987-4054 | | 1/1987 |
| JP | 1987-152912 | | 9/1987 |
| JP | 6-508590 | | 9/1994 |
| JP | 9-500581 | | 1/1997 |
| JP | 09-150833 | | 6/1997 |
| JP | 09150833 | | 6/1997 |
| JP | 10-167277 | | 6/1998 |
| JP | 3054459 | | 12/1998 |
| JP | 2000-6972 | | 1/2000 |
| JP | 2003-261141 | | 9/2003 |
| RU | 2059399 | | 5/1996 |
| WO | WO94/24002 | | 10/1994 |
| WO | WO 94/24002 | | 10/1994 |
| WO | WO 99/67141 | | 12/1999 |

OTHER PUBLICATIONS

Normann Copenhagen, Denmark, Design: Boje Estermann, 2005 Strainer: front and back of package and two photographs of strainer. Collapsible serving tray: date or designer unknown; two photographs: collapsed and extended.

U.S. Appl. No. 29/234,309, filed Jul. 15, 2005, Kusuma et al.

* cited by examiner

COLLAPSIBLE CONTAINER

BACKGROUND OF THE INVENTION

The present invention generally relates to molded plastic containers of the type commonly used for a variety of purposes including storage of both food items and non-food items, such containers preferably being adapted to receive an appropriate seal or lid. More specifically, the invention is concerned with containers of this type which, rather than being of a rigid construction as with a conventional bowl, are collapsible or foldable to a compact position when empty to facilitate convenient storage.

Such containers, in the form of cups, bowls, and the like, are generally known in the art and take many forms. These include collapsible cups or glasses wherein the glass is formed of telescopically stacked annular wall elements which slide relative to each other between a fully extended position and a collapsed position. As the wall elements are not integrally formed and slide freely relative to each other, there is a substantial possibility of leakage, and use other than as a temporary drinking vessel is not practical.

Another form of collapsible container more pertinent to the present invention is illustrated in U.S. Pat. No. 5,439,128, issued to Fishman on Aug. 8, 1995. In the Fishman container, the wall elements are integrally molded and consist of a series of vertical and angled elements alternately stacked to define the container wall. The elements, at the angular joint therebetween, are integrally joined by thin film hinges about which the wall elements fold. The actual downward folding and collapsing of the Fishman elements requires that the elements flex in order to accommodate the folding motion. This necessity for an actual flexing of the elements themselves, in addition to the folding at the film hinges, appears to be so significant as to, at least in some instances as illustrated in FIG. 3 of Fishman, require significant central relief grooves in each of the inclined wall elements which would appear to cause an inherent weakening of these wall elements.

SUMMARY OF THE INVENTION

A principle object of the present invention is to provide a collapsible container which presents or forms a substantially rigid receptacle in its open or expanded position and which, with an appropriate lid or seal snap-fit thereto, provides a practical watertight storage container for, as an example, an appropriate foodstuff or the like. The container is very convenient and provides a particularly desirable portable solution for food "on-the-go", such as at picnics, lunches for those who take their own lunch to work, and other instances wherein temporary storage is desired. The collapsible nature of the container, collapsing to a substantially completely compacted configuration of minimal height, particularly with a seal mounted thereon to confine any residue in the now empty container, allows the used container to be conveniently stored or packed away in a "brown bag", knapsack, picnic hamper, or the like, for subsequent cleaning and reuse.

Another significant aspect of the container of the invention is its capability to fold open in increments, one section at a time, to vary the capacity thereof and to maintain its incrementally folded position.

Other desired features of the invention include providing a container which can be washed in a dishwasher in its folded position and stacked therein in the same manner as conventional dishes, a container which stays open when in use and stays closed in storage, and a container which maximizes usable space for packing in a shipping carton as well as storage in the home.

In order to achieve the improved and highly practical container of the invention, the peripheral wall of the container, extending between a substantially rigid base and a substantially rigid top ring adapted to receive a snap-fit seal, includes a series of generally rigid annular or peripherally continuous wall sections edge joined to adjacent sections at fixed annular apex forming joints which are alternately inwardly and outwardly directed relative to the interior of the container. These sections include annular portions that are relatively flexible relative to the base and top ring. The wall sections, in the expanded or open position of the container, are themselves alternatively angled inward and outward relative to the interior of the container and relative to the vertical, with the wall sections, sequentially upward from the base to the top ring, each being generally diametrically or peripherally progressively greater than the base. The configuration thus formed for the expanded container will be that of an inverted truncated cone with the wall sections basically outwardly stepped upward from the base. This in turn allows for a direct downward collapsing of the wall sections into concentric surrounding relation to the base with the top ring surrounding the collapsed folded wall sections.

The actual folding of the wall sections relative to each other does not occur at the fixed apex forming joints therebetween. Rather, each of the wall sections includes an upper portion or flexure zone for a minor extent of the height thereof which is of a thickness less than that of the thickness of the remainder or lower portion of the wall section with the thicker portion of the wall section being generally stiffer or of limited flexibility. The thinner upper portion, in the expanded position of the container, is an arcuate continuation of the thicker portion of the wall section, forming an arc of greater than 90 degrees and, until physically moved over center during a collapsing of the container, provides a substantial degree of rigidity to the wall section for the full height thereof. Upon the application of a positive physical force collapsing the top ring and base toward each other, the thinner portions of the wall sections, positioned respectively below the actual angular joints or apices between the wall sections, will flex laterally in the direction of the fold in the manner of a flexible hinge with this flexure providing for both the actual folding and at the same time, minimizing any tendency for the wall sections to want to laterally flex or move as the wall sections collapse about each other. Each of the flexure zones formed by the thinner wall portions is bordered along each edge thereof by thicker wall portions of both the wall section from which the portion is defined and the wall section immediately thereabove. Once the arc of the flexure zone is reduced to less than 90 degrees, moving over center, the inherent resistance to the movement of the flexure zone is overcome and the collapsed zone assumes a dome-like configuration of less than 90 degrees. In moving from the closed to the open state, or vice-versa, each section, primarily in the flexure zone, is twisted and slightly distorted until it overcomes its stable position and then flips to the other position.

Expansion of the container from its collapsed position will involve a downward push or pull on the base as the top ring is moved vertically upward therefrom. As the flexure portions of the wall sections unfold and move to arcs of greater than 90 degrees, the wall will tend to rigidify and in effect lock the container in the open position.

Further features, objects and advantages of the invention will be noted as the construction and details of the invention are more fully hereinafter set forth.

DESCRIPTION OF THE PREFERRED EMBODIMENTS

Figure 1:
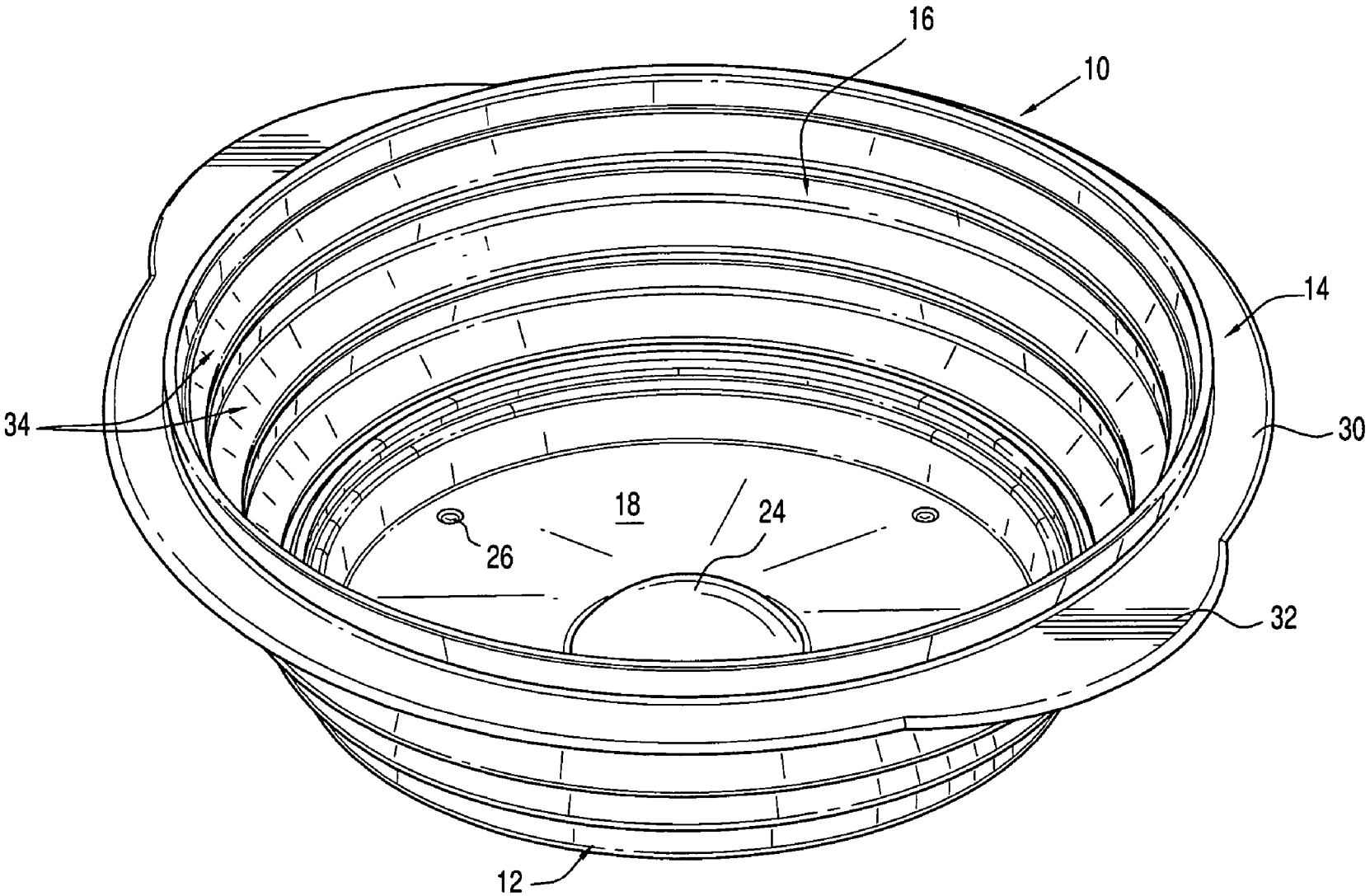
FIG. 1 is a top perspective view of the container of the invention in its open or expanded position.

Referring now more specifically to the drawings, the collapsible container 10 comprises a base 12, a top ring 14 and a folding wall 16 extending therebetween. The base 12 is a substantially rigid member including a bottom 18 with a peripheral upstanding base wall 20. The base, which may be flat, preferably includes a central slightly upwardly extending pressure area or bump of any appropriate configuration, such as a dome, to assist in expanding the container as shall be described subsequently. The base will also preferably have a series of small foot defining knobs 26 or a continuous foot rib, not shown, depending from the base bottom 18.

Figure 4:
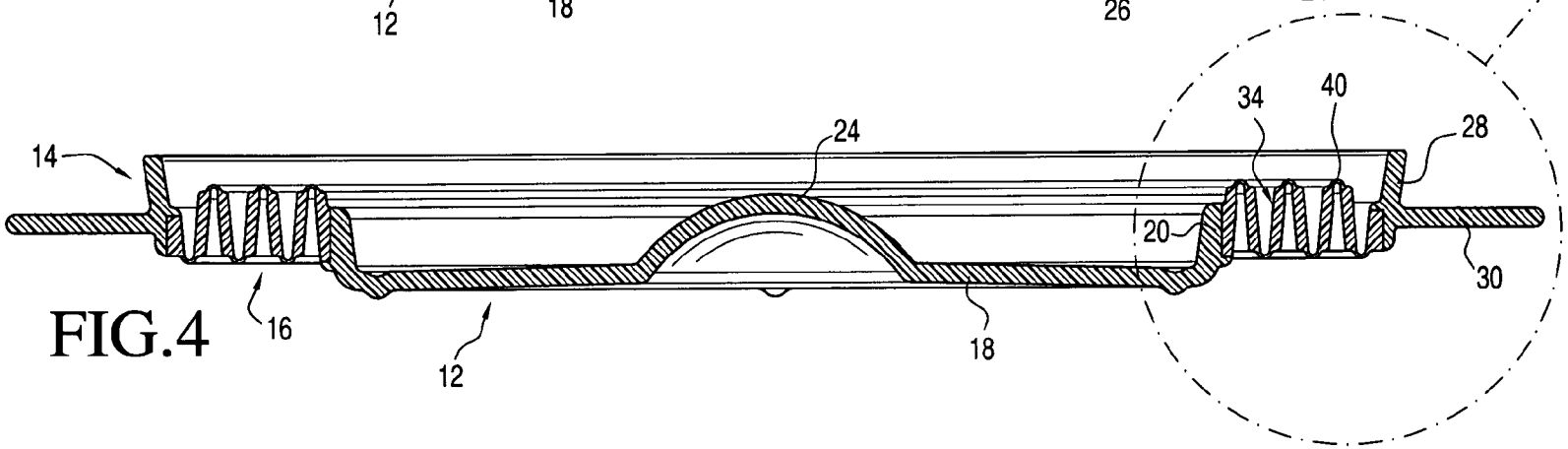
FIG. 4 is a transverse cross-sectional view of the collapsed container.

The top ring 14 includes a continuous or annular ring wall 28 with a peripheral horizontally outwardly directed flange 30 at approximately mid-height on the ring wall 28. The top ring 14, similarly to the base 12, is substantially rigid and is of a greater diameter or other non-circular cross-sectional area than the base 12 to encircle the base in the collapsed position of the container, as in FIG. 4, sufficiently outward thereof to accommodate the folded container wall therebetween. The top ring flange 30 provides additional lateral stiffness to the top ring, and a convenient means for handling the bowl, especially when filled. In addition, the ring flange 30, when the collapsed bowl is to be opened, allows a user to easily engage fingers about and under this flange 30 while pressing downward with the thumbs on the base domed pressure area 24 to forcibly vertically expand the base and top ring relative to each other. As an alternative to pressure on area 24, particularly with a large bowl, pressure can be applied sequentially about the base bottom 18 immediately adjacent the base wall 20 peripherally thereabout. As desired, and as will be best noted in FIGS. 1 and 2, the ring flange 30 can be slightly outwardly extended or enlarged at diametrically opposed portions to define gripping handles 32.

The molding of the base and top ring as separate entities from the wall is a preferred method of molding enabling the provision of substantially greater rigidity to these components relative to the wall sections, wherein the actual extending and collapsing action occurs, by utilization of polymers of differing degrees of rigidity, and/or flexibility.

The container side wall 16 is formed of a series of annular or peripherally continuous wall elements or sections 34, the lowermost section encircling and being intimately bonded, such as autogenously during a multi-component molding procedure, to the wall 20 of base 12 and seated on a support shoulder 21 slightly above the base bottom.

Figures 5A, 6A:
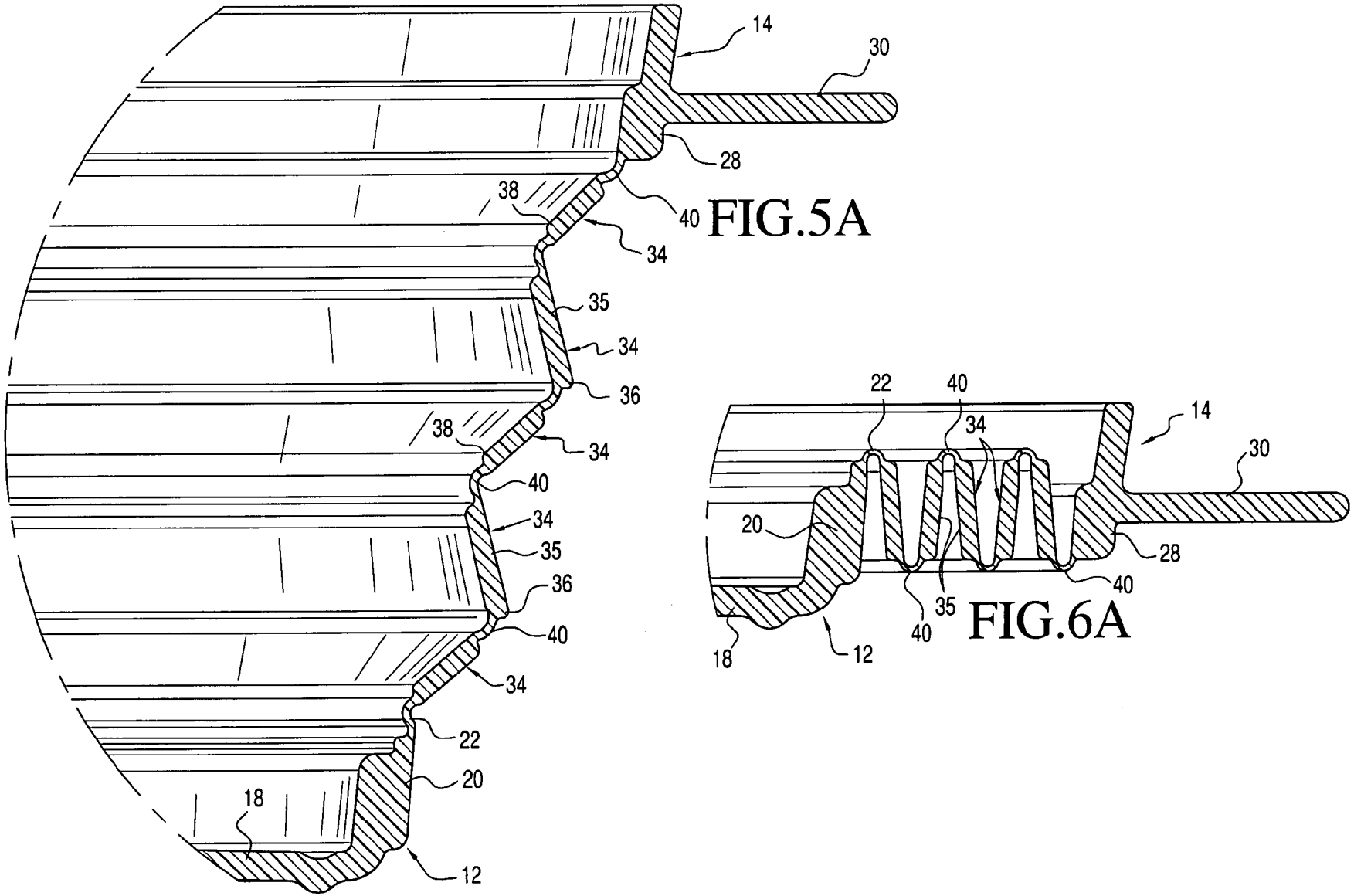
FIG. 5A is a view similar to FIG. 5 illustrating a modified construction.
FIG. 6A is a view similar to FIG. 6 illustrating the modified construction.

In the embodiment of FIG. 5A, the lowermost or bottom section, being of a height slightly less than the remaining sections thereabove, is integrally joined to a thin upwardly projecting base portion 22 which, as the container wall folds, will define a flexure zone between this lowermost wall section and the base.

The wall sections, upward from engagement of the lowermost section with the base, are alternately inclined outwardly and inwardly relative to the interior of the container and to the vertical with each section joined to the section immediately thereabove at alternating outwardly and inwardly directed apexes forming, respectively, angle joints 36 and 38.

Figures 5, 6:
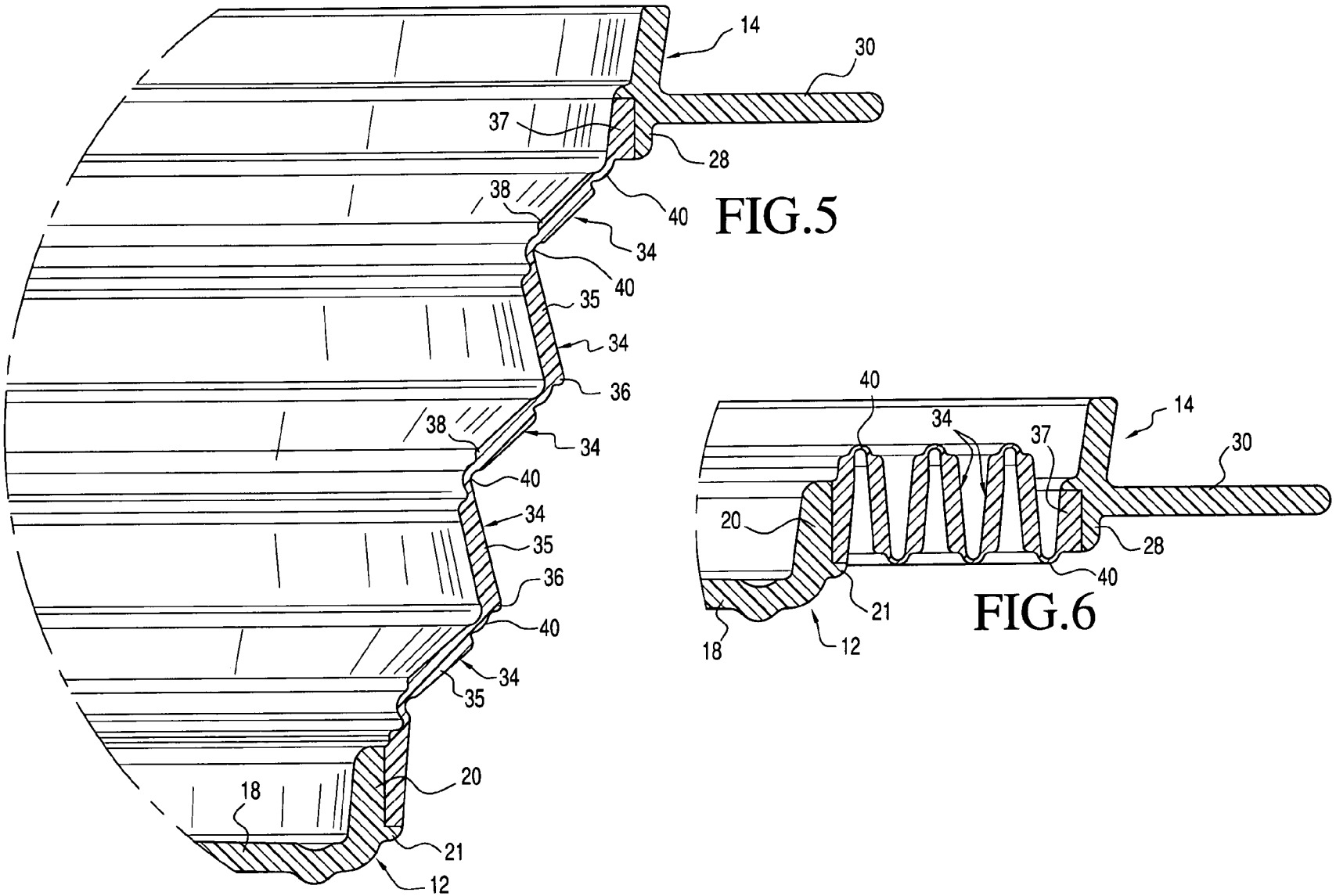
FIG. 5 is an enlarged detailed view of the area designated A in FIG. 3.
FIG. 6 is an enlarged detailed view of the area designated B in FIG. 4.

Noting FIG. 5, the uppermost or top section 34 terminates in an upwardly directed collar 37 received and intimately fixed within the lower portion of the ring wall 28, for example in the manner suggested with regard to the lowermost section. In the embodiment of FIGS. 5A and 6A, the uppermost section 34 is integral or otherwise intimately peripherally joined to the lower edge portion of the top ring 14.

Each of the alternately inclined wall sections, noting the open container, is of a predetermined thickness for a major portion 35 of the height thereof from the section lower edge with this lower major portion 35 being of limited flexibility relative to the associate flexure zone 40. The minor upper portion 40 of each wall section or element 34 is relatively thinner than the remainder of each section 34 and substantially equal in thickness to the extending portion 22 of the base in FIG. 5A. Each upper portion, similar to the portion 22, also forms a flexure zone immediately below the angled joint, 36 or 38, between each section and the section immediately thereabove. As noted, the height of these reduced thickness portions 40 extend for a minor portion of the overall height of the sections 34. These flexure zone portions 40, in the expanded or open position of the container, again noting FIG. 5, form, with regard to the outwardly inclined wall sections 34, continuations of the inner face of the corresponding major portion 35 therebelow, and, with regard to the inwardly inclined wall sections, are continuations of the outer face of the corresponding wall section. So formed, the thicker wall section portions 35 to each side of these flexure zone portions 40, and the angle thereof, inherently defining the direction of the folding action, note in particular the folding sequence suggested in FIG. 8. It will also be appreciated that, prior to folding, the flexure zones 40 and the positioning of these zones 40 outward of the actual angular joint or apex between adjacent sections, provides a degree of over center stability to prevent inadvertent collapse of the wall 16. This stability can only be overcome by a applying sufficient positive vertical pressure, forcing the top ring and base vertically toward each other to effect an over center movement of the flexure zones 40 and a "snap action" folding action of the zones to the collapsed position. Upon initiating the folding action, each involved flexure zone 35 distorts slightly until it moves to what might be considered an over center position, at which point it flips to the folded position. In this manner, any tendency for the container to self close or collapse accidentally, particularly with goods within the container, is minimized.

Figure 7:
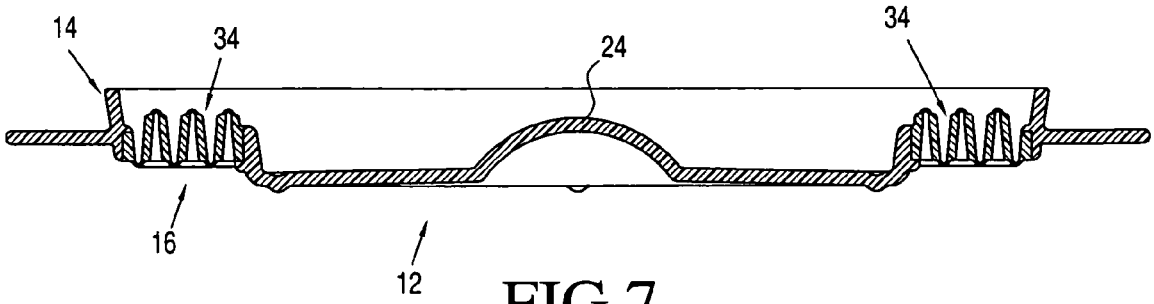
FIGS. 7, 8 and 9 sequentially illustrate one manner of opening, or closing the wall sections utilizing a twisting or sequential ratchet action.
Figure 8:
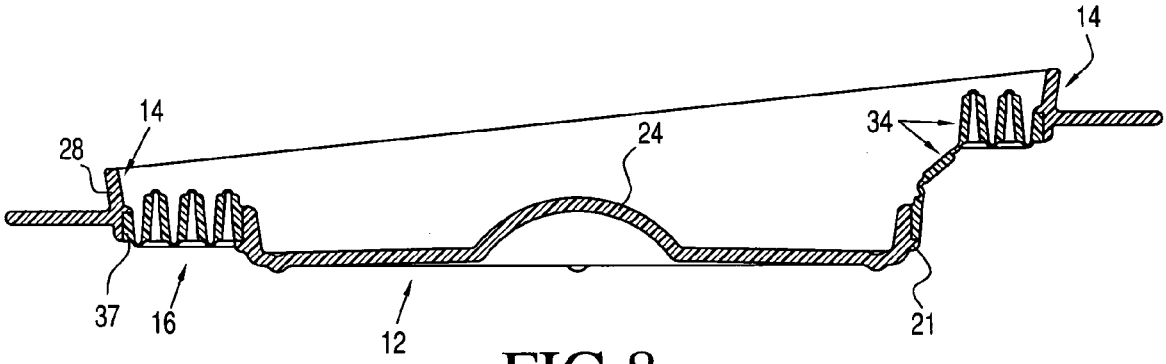
Figure 9:
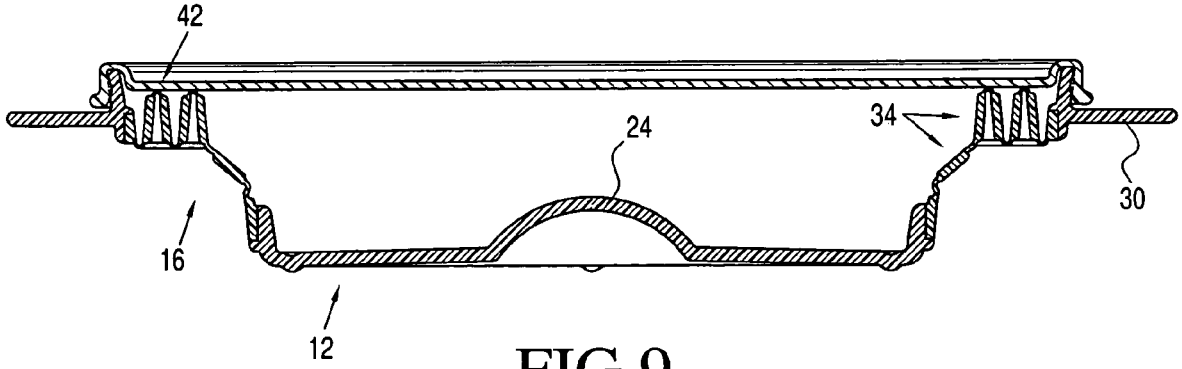

With particular attention to FIGS. 7-9, it will be seen that, if desired, both the opening and collapsing of the container can be facilitated by applying pressure sequentially about the container or by rotating the container as pressure is applied to provide a stepping or ratching effect on the wall sections 34 rather than by snap positioning each flexure zone in its entirety at one time.

FIG. 9 is of particular interest in showing the container partially folded or unfolded for use when a reduced capacity is desired or required. In such a position, the container is fully functional to receive and store foodstuffs and the like, and the seal 42, as in the open container of FIG. 3, is also fully functional in that the top ring is dimensionally stable in every position of the container.

Figure 3:
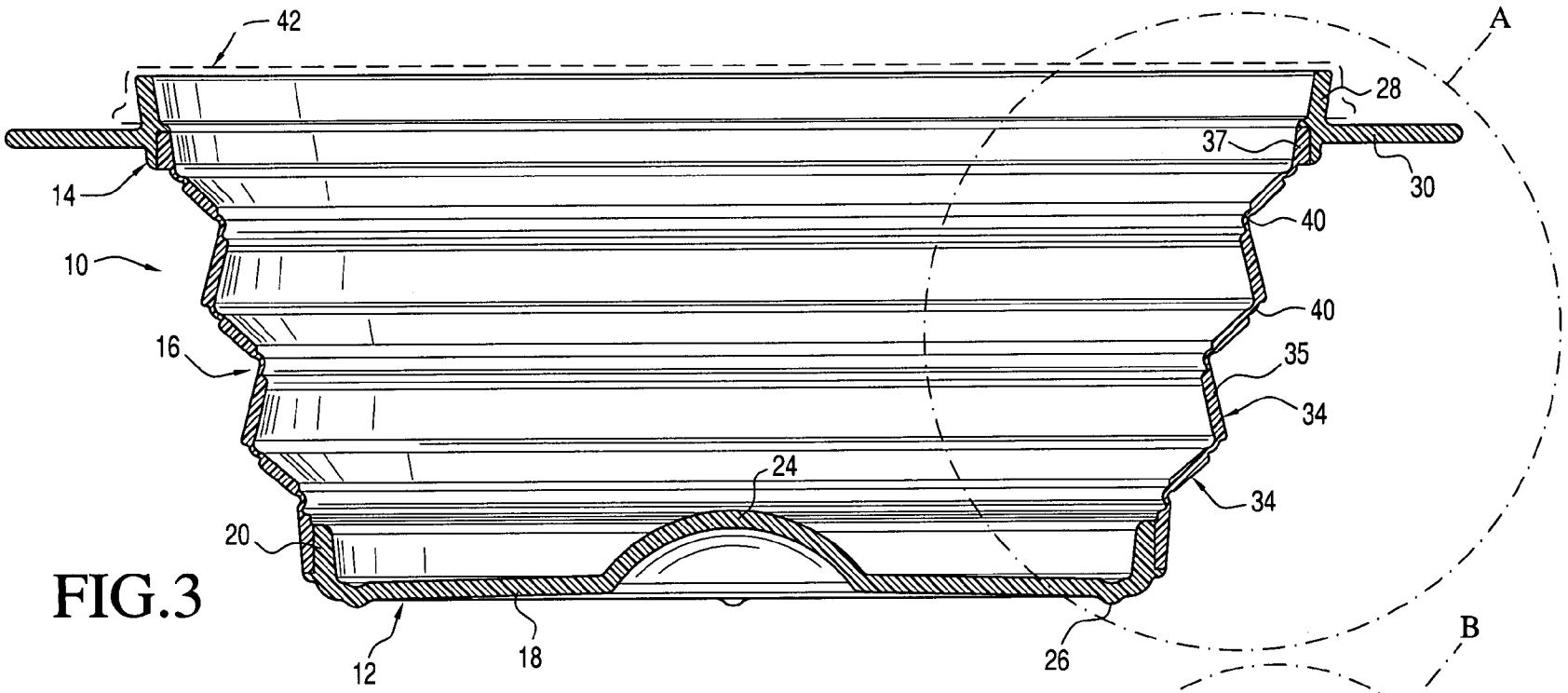
FIG. 3 is a transverse cross-sectional view of the expanded container.

Noting in particular FIG. 3, it will be seen that the general outward stepping of the sections upward from the base to the top ring form, in the open container, a generally inverted truncated conical configuration.

Again noting FIGS. 7-9, as the container is vertically collapsed, the flexure zones 40 of the individual wall sections 34 fold below the actual angle joint thereabove between adjacent sections to assume a generally domed configuration. Thus the adjacent wall sections are folded to bring the thicker major height 35 of the sections into concentric generally parallel relation to each other with the sections laterally aligned and surrounding said base between the base wall 20 and the top ring wall 28. This will best be seen in the cross-sectional detail of FIG. 6. The provision for formation of the actual flexure zone between adjacent sections remote or to one side of the angular joint between the sections facilitates the folding action. Any tendency for the wall to self collapse about the actual joint between the sections, as would be the case were the flexure zone 40 to define this joint, is minimized. Further, the formation of the flexure zone as an extension of the section provides a stiffness or additional degree of rigidity while allowing for a desired alternate inclination of each of the sections from the vertical which in turn provides for the desired compact collapsing of the wall sections within the annular confine defined between the base and top ring.

Figure 10:
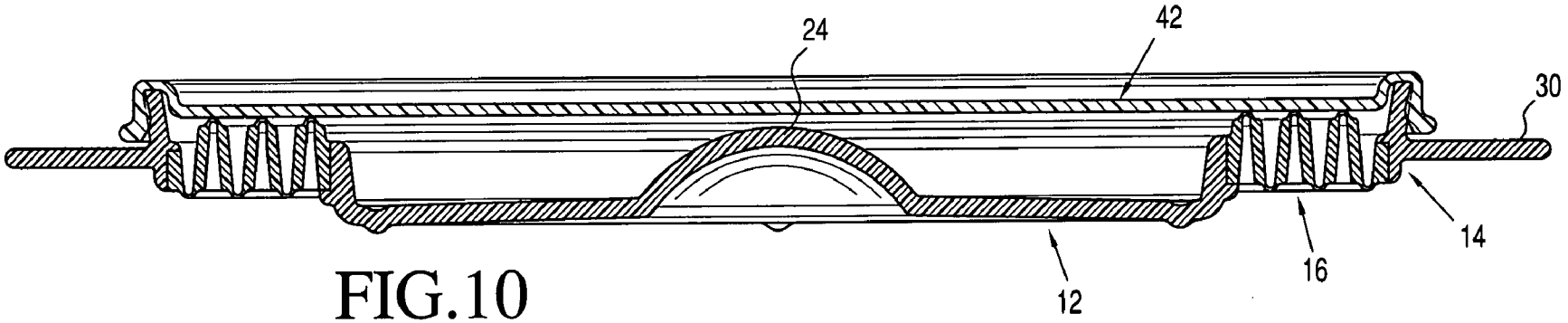
FIG. 10 is a cross-sectional view similar to FIG. 4 with the seal snap-fitted to the collapsed container.

Noting FIGS. 3, 9 and 10, it will be seen that the seal 42 is capable of being snap-fitted to the top ring 14 in an appropriate manner in any position assumed by the container. To facilitate this engagement, the upper portion of the top ring wall 28, above the circumferential flange 30, may be slightly outwardly inclined for reception within a peripheral downwardly directed groove on the seal. It is to be appreciated that inasmuch as the folded wall sections are, in any position of the container, positioned concentrically inward of the substantially rigid top ring 14, the seal 42 functions as an appropriate closure for the open container, the partially expanded container, and the collapsed container wherein a compacted storage position is achieved.

Figure 11:
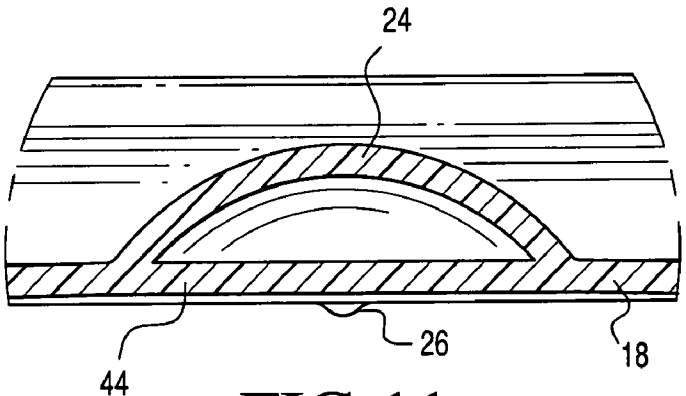
FIG. 11 is a cross-sectional detail of a modified pressure bump in the base provided with a pull bar.

As previously noted, when the container is to be opened prior to use, one need merely engage fingers about the peripheral flange 30 of the top ring and, with one or both thumbs, exert a downward pressure on the bottom push bump 24 projecting upwardly from the center of the base bottom 18. Alternately, pressure can be exerted on the bottom itself sequentially about the periphery thereof. Further, rather than relying on direct pressure on the bump 24 or bottom 18, and noting FIG. 11, a cross bar 44 can be provided diagonally across the concave recess or depression formed by the bump in the lower face of the bottom 18. This cross bar 44 can be physically gripped by the user's fingers for a direct downward pull on the container base, moving the base downward relative to the top ring and expanding the wall sections.

Again referring to FIG. 6, it will be noted that the lowermost folding wall section 34 will act as a limit to the downward collapsing of the remaining wall sections and top ring relative to the base wall, retaining the sections and top ring slightly above a support plane defined by the base bottom and support feet thereon whereby support of the container, both expanded and collapsed, is on the base and base feet rather than on the much thinner flexure zones.

The container as described is designed in a configuration that utilizes a "network" of flexure zones. It is not an accordion shape that stretches to open and close like a spring. Instead, the flat storage container functions to open and close based on a principle of "opposing angles".

In known expanding containers, the containers are generally molded in the open or expanded configurations. Open is thus the natural state for those containers, that is those containers would 'prefer' to remain open than in any other position. This is why when one tries to fold or collapse these containers, they tend to want to spring back open, that is return to their natural state. This is not the case with the container of the invention wherein the container is preferably molded in a flattened or collapsed position. This is its initial natural state meaning that the container will initially prefer to stay in this closed configuration. But there are multiple folds within the network of flexure zones. In the illustrated embodiment three sets of independently activating zones are provided (more can be added to increase capacity if desired). As seen in FIG. 9, each of the independently activatable flexure zones has a second 'natural' or at rest state when open wherein the fold will prefer to remain open independently or the remaining folds. In the present structure, both the action of collapsing the container and the action of expanding the container require the folds to be individually manipulated. Positive action is required to both fold and unfold the container. This can be referred to as the principle of "opposing angles". The angle of the fold in the closed position keeps the fold closed; the angle of the fold in the open position keeps the fold open. To move from the closed to the open state or vice-versa, the flexure zone is twisted and distorted slightly until it overcomes the opposing angle and then flips to the other position configuration. This action results because the diameters of the flexure zones cannot change. There is no other intermediate position for the fold. It is either open or closed, or it is being twisted (one side open and the other side closed). It is not possible in this construction for an individual section to be, as an example, half open while maintaining usable capacity. As previously noted, one easy way to manipulate the flexure zones is to 'ratchet' the container, one side at a time to a partial or fully open position.

The unique structure of the invention allows the container to remain flat when in the closed or collapsed position and remain expanded when in any open or partially open position. Because of the two 'natural' states for the flexure zones, the container prefers to remain closed when collapsed flat and prefers to remain open when expanded. With the independent activation of the flexure zones in the network, the container is capable of opening to fixed partial capacities, because the container prefers to remain open in these partial configurations. This is of particular value in maximizing and optimizing storage space as in a refrigerator, and dishwasher space when washing.

The collapsible container of the present invention has been described in the preferred embodiment as comprising one of molded plastic, i.e. synthetic polymers, having 'separate entities' comprising a base 12, top ring 14 and folding wall 16. The 'separate entities' in a preferred molding method may, for example, be realized by utilization of molding apparatus that enables multiple stage molding of the base 12, top ring 14 and folding wall 16, and wherein selection of polymers of varying degrees of substantial rigidity and/or general rigidity may be utilized. This also enables the varying of the color or light transmissivity of the base, top ring and folding wall.

It will be appreciated that as described in connection with the embodiment of FIGS. 5A and 6A, the container of the present invention may be molded as a unitary structure in essentially a single molding step. In addition, the described preferred difference in relative rigidity, or general, but more flexible, rigidity of the base 12 and ring 14 vis-a-vis the folding wall 16, may be achieved in a single molding step by selection of appropriate thicknesses of the several portions 12, 14 and 16. The possibility also exists to provide molding apparatus wherein a mold is configured to provide selected areas of the mold interior with polymers of varying degrees of rigidity or flexibility for the base 12, top ring 14 and wall 16.

Figure 2:
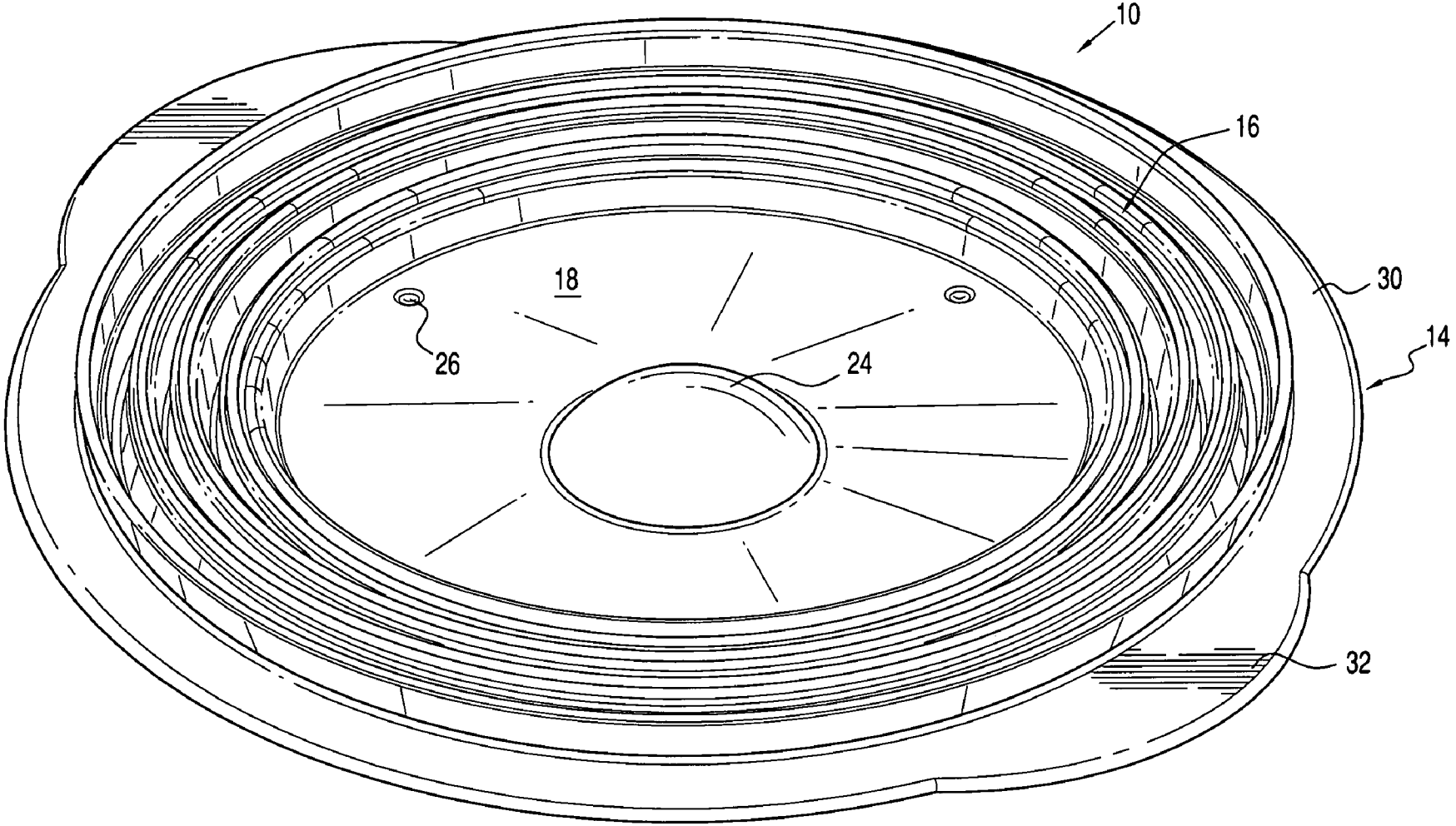
FIG. 2 is a top perspective view of the container fully collapsed.

Furthermore, while the container 10 preferably is molded in the collapsed position as shown in FIG. 2, it will be appreciated that the container 10, whether that of FIGS. 5 and 6 or FIGS. 5A and 6A, may be molded in an open or expanded position as shown in FIG. 1.

The foregoing is considered illustrative of the principles of the invention. As modifications and changes may occur to those skilled in the art, it is not desired to limit the invention to the exact construction and manner of use as shown and described. Rather, all suitable modifications and equivalents may be resorted to as falling within the scope of the invention as claimed.

The invention claimed is:

1. A collapsible container comprising a base, a top ring and a wall peripherally fixed to said base and top ring and extending therebetween, said container being adjustable between an expanded position with the top ring spaced upward from said base and forming a container interior, and a collapsed position with said top ring surrounding said base in outwardly spaced substantially concentric relation thereto, said wall comprising multiple upwardly extending peripherally continuous sections which, in the expanded position of said container, angle alternately outward and inward relative to the container interior, said sections, in the collapsed position of said container, being folded on each other and concentrically received generally between the base and the top ring with the sections encircling the base and in turn being encircled by said top ring, wherein the container includes flexure zones joining adjacent sections, the adjacent sections being of limited flexibility relative to the flexure zones, wherein said sections each have a thickness greater than the thickness of the flexure zones; and wherein each flexure zone is independently activatable for movement between a first, open natural state in which adjacent sections are unfolded, and a second, closed natural state in which the respective adjacent sections are folded; and wherein the container is adjustable to a fixed, partially expanded position between said expanded position and said collapsed position.

2. The container of claim 1, wherein in the expanded position, said sections form an obtuse angle.

3. The container of claim 1, wherein in the collapsed position, said sections form an acute angle.

4. The container of claim 1, wherein one of said flexure zones is disposed between the top ring and one of said sections.

5. The container of claim 1, wherein one of said flexure zones is disposed between the base and one of said sections.

6. The container of claim 1, wherein the top ring includes an annular flange extending outwardly therefrom.

7. The container of claim 1, wherein in the collapsed position, the folded sections are concentrically disposed between the base and the top ring.

8. The container of claim 1, wherein in the collapsed position, the folded sections are at an elevation wherein the lowest elevation of the base is lower than the lowest elevation of the folded section.

9. The container of claim 1, wherein a portion of the wall overlays a portion of the base.

10. The container of claim 1, wherein the wall is molded in the collapsed position.

11. The container of claim 1, wherein the base is non-permeable.

12. A collapsible container comprising: a base, a top ring, and a wall extending between the top ring and the base, wherein the wall has at least a first section, a second section, and a third section, wherein the first section is adjacent the second section and wherein the second section is adjacent the third section, a first flexure zone disposed between the first section and second section, a second flexure zone disposed between the second section and the third section, and a third flexure zone disposed between the third section and the base, wherein the first and second sections each have a thickness greater than the thickness of the first flexure zone, and the second and third sections each have a thickness greater than the thickness of the second flexure zone, wherein the container is adjustable between at least an expanded position forming an interior and having a first volume, a partially expanded position having a second volume less than the first volume, and a collapsed position with said top ring surrounding said base in outwardly spaced substantially concentric relation thereto with the sections being folded and concentrically received generally between the base and the top ring with the sections encircling the base and in turn being encircled by said top ring; wherein in the expanded position, the first section angles outward relative to the interior, and the second section angles inward relative to the interior; and wherein said container is stable in each of said positions and wherein positive force is required to adjust the container from the partially expanded position to the expanded position, and to adjust the container from the partially expanded position to the collapsed position.

13. The container of claim 12 wherein in the expanded condition, the first and second sections form an obtuse angle.

14. The container of claim 12 wherein in the collapsed condition, the first and second sections form an acute angle.

15. The container of claim 12, wherein the first flexure zone is substantially arcuate.

16. The container of claim 12, further comprising a fourth flexure zone disposed between the third section and the top ring.

17. The container of claim 12, wherein in the expanded position, the third section angles outward relative to the interior.

18. The container of claim 12, wherein the top ring includes an annular flange extending outwardly therefrom.

19. The container of claim 12, wherein in the collapsed position, the first, second, and third sections are folded and concentrically disposed between the base and the top ring.

20. The container of claim 12, wherein in the collapsed position, the first section and the second section form a first angled opening, wherein the base at least partially defines a support plane, and wherein the centerline of the first angled opening is substantially perpendicular to the support plane.

21. The container of claim 12, wherein in the collapsed condition, the folded portion of the wall and the base are each at an elevation, wherein the lowest elevation of the base is lower than the lowest elevation of the folded portion of the wall.

22. The container of claim 12, wherein a portion of the wall overlays a portion of the base.

23. The container of claim 12, wherein the wall is molded in the collapsed position.

24. The container of claim 12, wherein the base is non-permeable.

25. The container of claim 12, wherein the first, second, and third flexure zones each have a thickness, and wherein the thickness of the first, second, and third flexure zones is substantially equal.

* * * * *